US005244422A

United States Patent [19]

Laricchia

[11] Patent Number: 5,244,422

[45] Date of Patent: Sep. 14, 1993

[54] WEDGE CONNECTOR

[75] Inventor: Rocco V. Laricchia, Pickering, Canada

[73] Assignee: The Whitaker Corporation, Wilmington, Del.

[21] Appl. No.: 940,603

[22] Filed: Sep. 4, 1992

[51] Int. Cl.[5] ..... H01R 4/50

[52] U.S. Cl. ..... 439/783; 439/790; 439/863

[58] Field of Search ..... 439/783, 790, 863

[56] References Cited

U.S. PATENT DOCUMENTS

| | | | |
|---|---|---|---|
| 2,106,724 | 2/1938 | Cope | 339/247 |
| 3,065,449 | 11/1962 | Matthysse et al. | 439/783 |
| 3,275,974 | 9/1966 | Mixon, Jr. | 439/783 |
| 4,600,264 | 7/1986 | Counsel | 339/247 |
| 4,634,205 | 1/1987 | Gemra | 439/863 |
| 4,650,273 | 3/1987 | Roosdrop | 439/863 |
| 5,006,081 | 4/1991 | Counsel et al. | 439/783 |
| 5,044,996 | 9/1991 | Goto | 439/783 |
| 5,145,420 | 9/1992 | Counsel et al. | 439/783 |

*Primary Examiner*—Paula A. Bradley

*Attorney, Agent, or Firm*—Katherine A. Nelson; Bruce J. Wolstoncroft

[57] ABSTRACT

A wedge connector of the type having a C-shaped member defining wire-receiving channels and a wedge member arranged to be forced between the wires thereby securing the wires electrically and mechanically together. Raised, pointed projections are provided in the inner surface of each channel, these projections biting into the wires to increase the required pull-out force. A slot is provided in the wedge and in the fully engaged position of the connector pieces the slot is exposed adjacent an end of the C-member. This allows insertion of a flat screwdriver which can be backed against the end of the C-member to pry the wedge loose.

9 Claims, 2 Drawing Sheets

WEDGE CONNECTOR

BACKGROUND OF THE INVENTION

This invention relates to a wedge connector of the type having a C-shaped member defining spaced wire-receiving channels and a wedge member arranged to be forced between the wires and secure the wires between the wedge member and the C-member.

As disclosed in U.S. Pat. Nos. 1,801,277; 4,415,222; 4,600,264 and 5,006,081 interengaging portions of the two members are arranged to lock together in the wedged position to secure the connection.

One such connector in use is the C-LOK (trade-mark) series of connectors manufactured by AMP Incorporated. These connectors are arranged to be fastened using parallel headed pliers and disconnected using a special tool. Although the connection achieved is sufficient for many applications for heavier gauge wires the mechanical pull-out strength of the connection may not be adequate.

In another product also manufactured by AMP Incorporated and known as AMPACT (trade-mark) a special tool using an explosive cartridge is used for connecting and disconnecting the connector pieces to and from the wires.

It is an object of the present invention to provide a wedge connector which can be applied by ordinary pliers but which exhibits superior pull-out strength.

It is a further object of the invention to provide a wedge connector which can easily be disassembled without requiring a special tool.

SUMMARY OF THE INVENTION

The wedge connector of the invention includes in the inner surface of each channel of the C-member a contact portion which is knurled or otherwise provided with raised projections. More particularly, in a preferred embodiment the projections are formed as pyramid shaped pointed projections.

The raised projections bite into the wires to reduce slippage and twisting of the wires and enhance the pull-out strength which would be achieved with the locking means alone. Typically a 75% better pull-out force is achieved when joining aluminum to aluminum conductors.

The wedge member is also provided with a slot which, in the fully engaged position of the connector pieces is exposed adjacent an end of the C-member. A flat screwdriver may be inserted in the slot and backed against the end of the C-member to pry the wedge loose.

DESCRIPTION OF THE PREFERRED EMBODIMENTS

Figure 1:
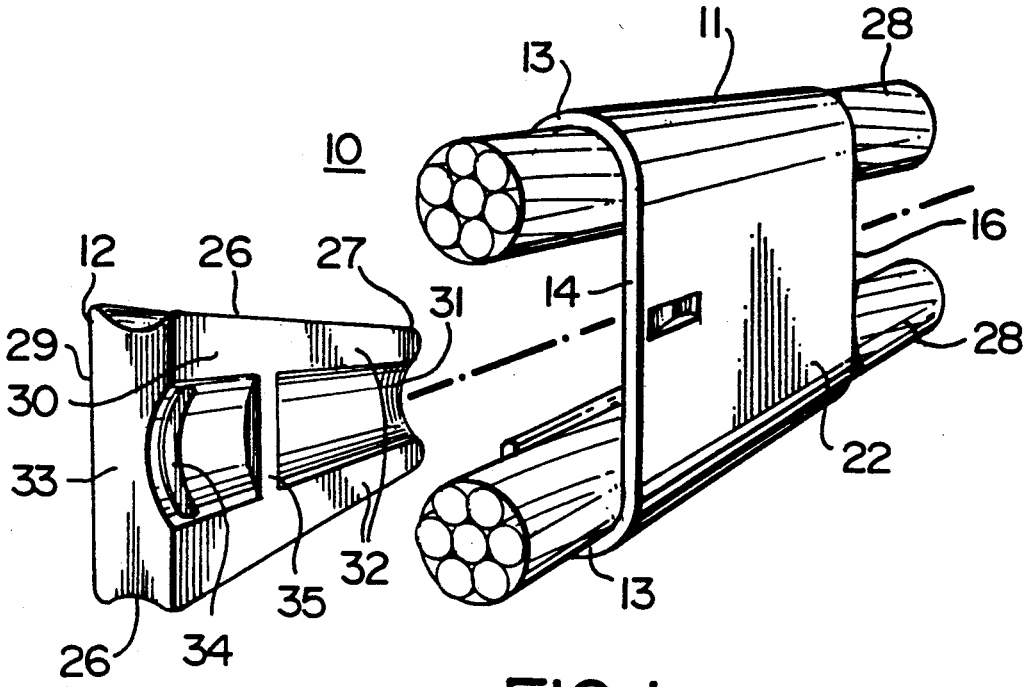
FIG. 1 is an isometric view of the wedge connector according to the invention prior to connection to a pair of wires.
Figure 2:
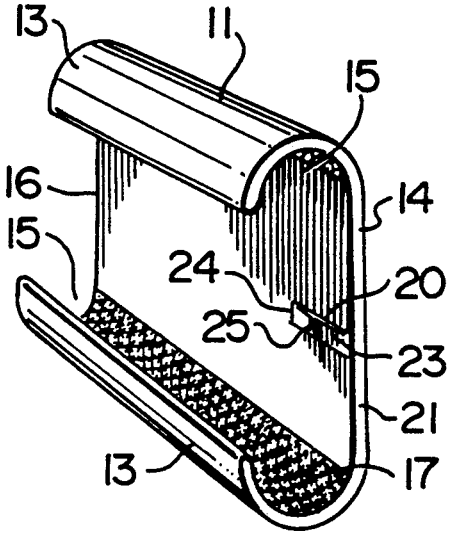
FIG. 2 is an isometric view showing the C-member of the wedge connector from a side opposite from that shown in FIG. 1.

Referring particularly to FIGS. 1 and 2, the wedge connector 10 of the invention is formed by two components, namely a symmetrical C shaped member 11 and a wedge member 12.

The C-member 11 has two rolled over edges 13 spaced apart by a central web 14. The rolled over edges 13 respectively define inwardly facing channels 15 and the member 11 is tapeed towards one end 16 such that the channels 15 converge towards that end.

Figure 3:
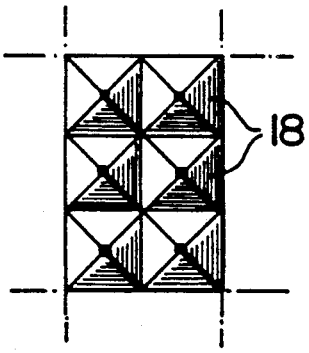
FIG. 3 is a top view illustrating the pyramid groove design used in the C-member.
Figure 4:
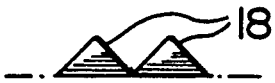
FIG. 4 is a side view of the pyramid groove design.

The inner surface of each channel 15 is provided with knurled finish 17. As can be seen in FIGS. 3 and 4 the knurled finish is in the form of a pyramid groove design comprising four sided pyramids 18 projecting 0.030 inch, for example, towards the interior of the channel.

A locking detent 20 is provided in the web 14 intermediate the two channels 15 and proximate the wider end 21 of the C-member 11. The detent 20 projects forwardly from the web 14 on the same side of the web as the channels 15 are disposed. Preferably the detent 20 is formed by punching or stamping a depression in the rear face 22 of the web 14. The detent 20 is preferably generally triangular having are relatively long ramp portion 23 facing wider end 21 of C-member 11 and a relatively short ramp portion 24 facing away from end 21, a ridge 25 being defined between the two ramp portions.

The wedge member 12 is provided with two concave outwardly facing surfaces 26 extending along opposite edges of member 12 which is tapered towards one end 27 such that the concave surfaces 26 converge towards that end. The taper of wedge member 12 is substantially identical to the taper of C-member 11 and the members 11 and 12 are so dimensioned relatively that, in use, the concave surfaces 26 may be spaced from the channels 15 to receive conductor wires 28 respectively therebetween. The length of both members 11 and 12 as measured along the taper may be substantially similar.

The wedge member 12 has two spaced surfaces 29 and 30 extending between the concave surfaces 26. One of the surfaces, namely surface 29, is planar and the other 30 is contoured having a central concave groove 31 located between two tapered planar portions 32. Located in the central groove 31 proximate the wider end 33 of the wedge is a slot 34 which is aligned substantially parallel to end 33 and extends some way toward planar surface 29. The slot is sized and configured to receive the end of a tool such as a flat screw driver. Spaced forwardly of the slot 34 in a direction towards end 27 of the wedge member is an abutment 35 which extends across groove 31.

Figure 5:
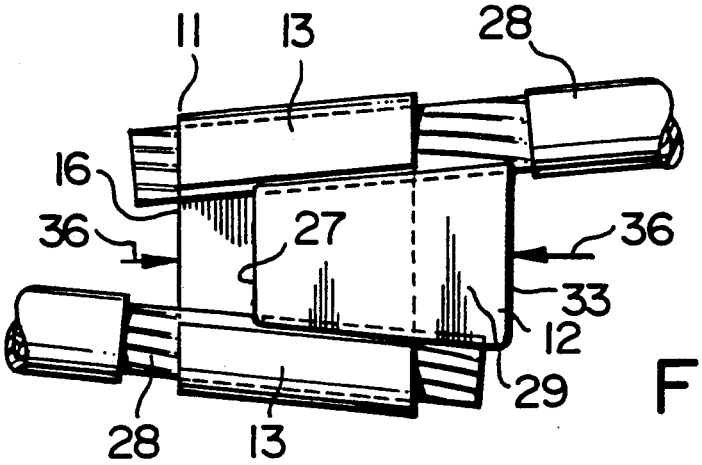
FIG. 5 is a view form the front showing the wedge connector in the process of being applied to a pair of wires.

Referring now to FIG. 5, which shows how the connector 10 is applied, the end portions of two wires 28 are received respectively in the channels 15 of C member 11 with the wires 28 extending generally in opposite directions from each other. The wires could, alternatively, be disposed so as to extend generally in the same direction away from the C-member 11. The wedge member 12 is then inserted narrow end 27 first into the space between channels 15 at the wider end 21 of C-member 11 with the concave surfaces 26 aligned with the channels 15 and receiving therebetween the wires 28. The wedge is orientated such that contoured surface 30 is adjacent the web 14 of C-member 11.

Initially the wedge is applied by finger pressure. Then a tool such as a common pair of parallel headed pliers is applied to narrow end 16 of C-member 11 and wider end 33 of wedge member 12 as indicated by the arrows 36. The pliers are depressed to force the wedge member 12 between the wires 28 and ultimately to force detent 20 of C-member 11 over abutment 35 of wedge member 12. The long ramp portion 23 assists in passage of the detent 20 past the abutment 35 as the web 14 flexes slightly. The depression of the pliers is continued until the ridge 25 of the detent 20 snaps behind the abutment 35 which the operator can detect in a tactile manner.

As the wedge member 12 is forced between the wires 28 the pyramid projections 18 bite into the wires thereby increasing the electrical and mechanical interconnection between the connector 10 and the wires. The combination of the knurled finish 17 and the locking detent/abutment provides a mechanically strong pull out resistance.

Figure 6:
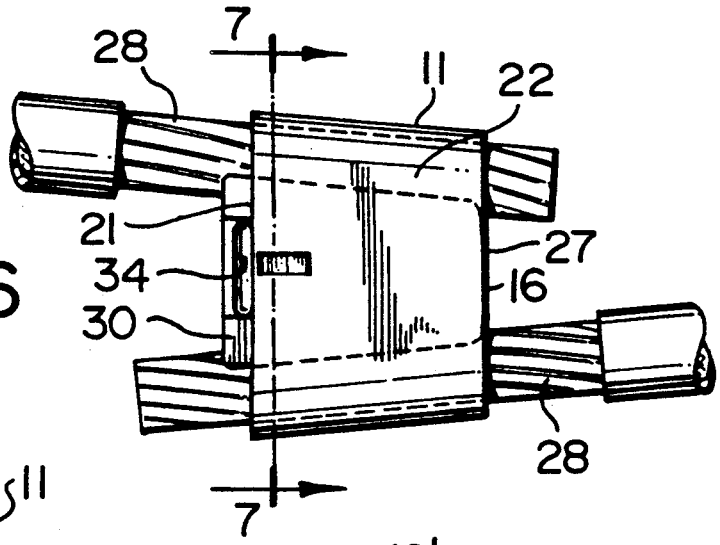
FIG. 6 is a view form the rear showing the wedge connector in its final condition interconnecting the pair of wires.
Figure 7:
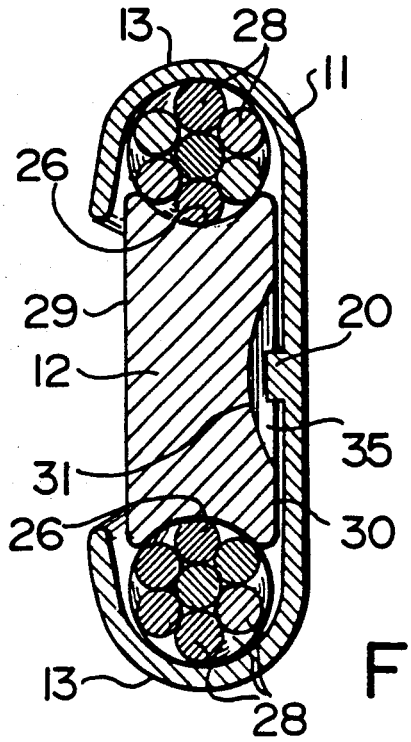
FIG. 7 is a cross-sectional view taken on line 7—7 of FIG. 6 and drawn to an enlarged scale.

With the detent 20 thus locked behind abutment 35, the spacing between the abutment 35 and slot 34 is such that the slot 34 is exposed adjacent the wider end 21 of C-member 11 as seen in FIG. 6. To remove the connector 10 from the wires 28 the end of a flat screwdriver is inserted into the slot 34 and the screwdriver is backed against the end 21 of C-member 11 to pry the wedge member 12 to the left as seen in FIG. 6 and away form C-member 11. Sufficient force can easily be achieved to overcome the locking action provided by detent 20 as enhanced by pyramid projections 18.

Figure 8:
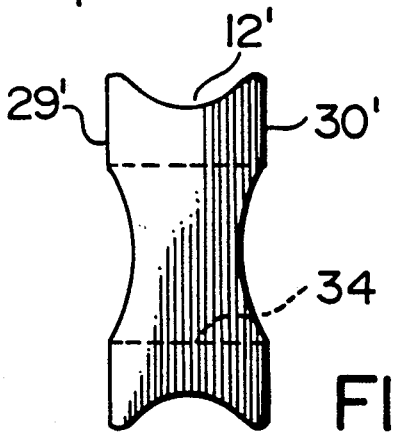
FIG. 8 is an end view of a modified version of the wedge member of the wedge connector.

In the embodiment illustrated in FIG. 8 both surfaces 29' and 30' of wedge member 12 are identically contoured in the manner of contoured surface 30 of the first embodiment. This has the advantage that the wedge member 12 can be applied with either surface 29' or 30' adjacent web 14 thereby simplifying use. In this embodiment too the slot 34 is shown extending completely through the wedge member 12. However, two separate slots as in the first embodiment could be used instead. Furthermore, in the first embodiment the slot 34 could be formed as a through slot rather than the blind slot illustrated.

The connector was primarily developed for interconnecting aluminum wires and is for that purpose manufactured preferably of aluminum but, of course, should not be limited to such material. As is known, an inhibitor compound which assists in the prevention of oxide forming at the contact area, can be provided as a coating on the concave surfaces 26 of the wedge member 12 and on the channels 15 of C-member 11.

The spacing between the abutment 35 and slot 34 must be arranged such that the slot is at least partially exposed in the locked position. If the slot 34 is completely exposed, it must be located adjacent the end 21 of C-member 11 such that, in either case, a screwdriver can be backed against end 21 to pry the wedge member free of the C-member.

What I claim as my invention is:

1. An electrical connector for interconnecting a pair of electrical wires comprising a C-member and a wedge, the C-member having two curved edges spaced apart by a web, the curved edges defining a pair of inwardly facing channels, the C-member being tapered towards one end such that the channels converge towards the one end, an inner surface of each channel being provided with raised projections, the wedge having concave outwardly facing surfaces extending along opposite edges of the wedge and two spaced sides extending between the concave surfaces, the wedge being tapered towards one end such that the concave surfaces converge towards the one end, interengaging locking means provided on the C-member and wedge whereby the wedge may be applied o the C-member by means of a pair of pliers until the locking means engage with each other to interconnect mechanically and electrically a pair of wires positioned between the channels and concave surfaces, the raised projections biting into the wires thereby increasing the electrical and mechanical interconnection, and the wedge further includes a forwardly facing tool engaging surface adjacent the rearward end of the wedge adapted for engagement with a tool work end member to enable prying by the tool member to effect removal of the wedge from the C-member.

2. An electrical connector according to claim 1 in which the raised projections are pointed pyramids.

3. An electrical connector according to claim 1 in which the locking means comprises a detent on the web proximate a wider end of the C-member and an abutment provided on a side of the wedge.

4. An electrical connector according to claim 1 in which the forwardly facing tool engaging surface is defined by a slot on at least one side of the wedge for engagement with a tool to disengage the wedge from the C-member.

5. An electrical connector according to claim 4 in which the slot is so located on the wedge that when the wedge is fully engaged with the C-member the slot is exposed adjacent a wider end of the C-member.

6. An electrical connector according to claim 1 in which the forwardly facing tool engaging surface is defined by a respective slot provided on each side of the wedge for engagement with a tool to disengage the wedge from the C-member.

7. An electrical connector according to claim 6 in which each slot is so located on the wedge that when the wedge is fully engaged with the C-member the slots are exposed adjacent a wider end of the C-member.

8. An electrical connector according to claim 1 in which the forwardly facing tool engaging surface is defined by a through slot which extends between the two sides of the wedge for engagement with a tool to disengage the wedge from the C-member.

9. An electrical connector according to claim 8 in which the slot is so located on the wedge that when the wedge is fully engaged with the C-member the slot is exposed adjacent a wider end of the C-member.

* * * * *

UNITED STATES PATENT AND TRADEMARK OFFICE

CERTIFICATE OF CORRECTION

PATENT NO. : 5,244,422

DATED : September 14, 1993

INVENTOR(S) : Rocco V. Laricchia

It is certified that error appears in the above-identified patent and that said Letters Patent is hereby corrected as shown below:

Claim 1, line 16, column 4, "o" should be --to--.

Signed and Sealed this

Twelfth Day of April, 1994

Attest:

Bruce Lehman

BRUCE LEHMAN

Attesting Officer

Commissioner of Patents and Trademarks